US006606591B1

(12) United States Patent
Su

(10) Patent No.: US 6,606,591 B1
(45) Date of Patent: Aug. 12, 2003

(54) SPEECH CODING EMPLOYING HYBRID LINEAR PREDICTION CODING

(75) Inventor: Huan-yu Su, San Clemente, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/548,204

(22) Filed: Apr. 13, 2000

(51) Int. Cl.[7] ..... G10L 19/06
(52) U.S. Cl. ..... 704/219; 704/220
(58) Field of Search ..... 704/200, 203, 704/204, 217, 219, 220, 223, 230, 501, 503

(56) References Cited

U.S. PATENT DOCUMENTS 4,817,141 A * 3/1989 Taguchi ..... 704/219
5,819,212 A * 10/1998 Matsumoto et al. ..... 704/219
5,937,378 A * 8/1999 Serizawa ..... 704/230
6,202,045 B1 * 3/2001 Ojala et al. ..... 704/203

* cited by examiner

*Primary Examiner*—Daniel Abebe

(74) *Attorney, Agent, or Firm*—Farjami & Farjami LLP

(57) ABSTRACT

A speech coding system that employs hybrid linear prediction coding during extraction of linear prediction coefficients within ITU-Recommendation speech coding standards. The present invention is operable within linear prediction speech coding systems including code-excited linear prediction speech coding systems, and it provides for a substantially improved perceptual quality of reproduced speech signals when compared to conventional speech coding methods that employ the commonly known auto-correlation method that is based on minimizing the linear prediction coding (LPC) prediction error energy. The invention is operable to provide for high perceptual quality of reproduced speech signals having substantial differences of energy in various frequency bands. For example, for speech signals having information dispersed broadly across the frequency spectrum, such as having a significant amount of information at low frequency and a significant amount of information at high frequency, the invention provides a way to maintain a high perceptual quality across the broad frequency range. The invention generates a single set of linear prediction coefficients (LPCs) either directly from the speech signal in certain embodiments of the invention, or alternatively, interveningly through the use of line spectral frequencies (LSFs) that are generated from different sets of linear prediction coefficients (LPCs) generated from the speech signal itself in other embodiments of the invention.

27 Claims, 8 Drawing Sheets

SPEECH CODING EMPLOYING HYBRID LINEAR PREDICTION CODING

BACKGROUND

1. Technical Field

The present invention relates generally to speech coding; and, more particularly, it relates to hybrid extraction of linear prediction coefficients as a function of frequency within speech data.

2. Related Art

Conventional speech coding systems that employ linear prediction speech coding, such as code-excited linear prediction speech coding, uses methods based on minimizing the prediction error energy associated with the linear prediction coefficients ($LPC_s$) generated during the encoding of a speech signal, such as the auto-correlation method. This conventional method is inherently an energy driven system. For typical broad band signals that are frequently present within speech coding systems, the linear prediction coefficients ($LPC_s$) are very representative of the speech signal, but for speech signals having a widely dispersed power spectral density, the spectral information in one portion of the speech signal is commonly under-represented by the linear prediction coefficients ($LPC_s$) and its associated parameters. This under-representation provides an undesirably poor speech quality when the speech signal is later reproduced in the speech coding system.

Specifically, one concern for conventional speech coding systems is that when there is a large disparity between the energy levels across the frequency spectrum of the speech signal, the conventional methods of speech coding that generate a single set of linear prediction coefficients ($LPC_s$) for the speech signal fail to provide a high perceptual quality upon subsequent reproduction of the speech signal.

Further limitations and disadvantages of conventional and traditional systems will become apparent to one of skill in the art through comparison of such systems with the present invention as set forth in the remainder of the present application with reference to the drawings.

SUMMARY OF THE INVENTION

Various aspects of the present invention can be found in a speech codec that performs linear prediction speech coding on a speech signal. The speech codec includes, among other things, an encoder circuitry and a decoder circuitry that are communicatively coupled via a communication link. The encoder circuitry receives the speech signal that is provided to the speech codec. In addition, the speech codec contains a linear prediction coefficient parameter extraction circuitry that extracts two sets of linear prediction coefficients during the coding of the speech signal and a linear prediction coefficient combination circuitry that combines the two sets of linear prediction coefficients to generate a hybrid set of linear prediction coefficients.

The linear prediction coefficient parameter extraction circuitry itself contains a high frequency speech signal processing circuitry and a low frequency speech signal processing circuitry. The high frequency speech signal processing circuitry extracts a set of linear prediction coefficients representing better a high frequency component of the speech signal, and the low frequency speech signal processing circuitry extracts a set of linear prediction coefficients representing better a low frequency component of the speech signal.

The linear prediction coefficient combination circuitry takes as input the two sets of linear prediction coefficients and performs appropriate hybrid combination in order to generate a new set of linear prediction coefficients (LPCs) to be used by the speech codec. In certain embodiments of the invention, the two sets of linear prediction coefficients are first converted to the line spectral frequency (LSF) domain, then a hybrid combination in line spectral frequency (LSF) domain takes place to obtain a combined set of line spectral frequencies (LSFs), which is converted back to the linear prediction coefficient (LPC) domain to obtain the hybrid combined set of linear prediction coefficients (LPCs). In other embodiments of the invention, the hybrid combination might take place in other parameter domains, such as reflection coefficients, auto-correlation coefficients, or even in the original speech signal domain. It is understood that proper parameter conversions back and forth and appropriate weighting function for the combination are necessary and essential.

In certain embodiments of the invention, the speech codec further calculates a set of line spectral frequencies (LSF) from the calculated linear prediction coefficients (LPCs). The line spectral frequencies are used by the linear prediction coefficient combination circuitry to perform the hybrid combination of the two sets of linear prediction coefficients. The final set of linear prediction coefficients corresponds to a hybrid combination of the sets of linear prediction coefficients. In other embodiments of the invention, the speech codec further determines speech signal spectral information from the speech signal, and wherein the speech signal spectral information from the speech signal is used by the linear prediction coefficient parameter extraction circuitry to perform the combination of the two sets of linear prediction coefficients.

The linear prediction coefficient combination circuitry combines the two sets of linear prediction coefficients to generate a hybrid set of linear prediction coefficients by employing a weighted averaging to combine the two sets of linear prediction coefficients. The linear prediction coefficient parameter extraction circuitry extracts at least one additional set of linear prediction coefficients during the coding of the speech signal in certain embodiments of the invention. The linear prediction coefficient combination circuitry that combines the two sets of linear prediction coefficients to generate a hybrid set of linear prediction coefficients employs a weighted averaging to combine the two sets of linear prediction coefficients and to produce the at least one additional set of linear prediction coefficients. If desired, the entirety of the speech codec is contained within a speech signal processor.

Other aspects of the present invention can be found in a speech coding system that performs hybrid extraction of linear prediction coefficients (LPCs) during coding of a speech signal. The speech coding system itself contains, among other things, a linear prediction coefficient parameter extraction circuitry and a linear prediction coefficient combination circuitry. The linear prediction coefficient parameter extraction circuitry extracts at least two sets of linear prediction coefficients during the coding of the speech signal, and the linear prediction coefficient combination circuitry combines the at least two sets of linear prediction coefficients to generate a hybrid set of linear prediction coefficients.

In certain embodiments of the invention, the speech coding system further determines the spectral content of the speech signal after first having generated the linear prediction coefficients (LPCs), and the spectral content of the speech signal is used by the linear prediction coefficient parameter extraction circuitry to perform the combination of the sets of linear prediction coefficients (LPCs). The speech codec calculates a set of line spectral frequencies using the linear prediction coefficients (LPCs), and the line spectral frequencies are used by the linear prediction coefficient combination circuitry to perform the hybrid combination of the sets of linear prediction coefficients (LPCs). One of the at least two sets of linear prediction coefficients corresponds to a pre-emphasized component of the speech signal. If desired, the entirety of the speech coding system is contained within a speech signal processor.

In other embodiments of the invention within the speech coding system, one of the at least two sets of linear prediction coefficients corresponds to a high frequency component of the speech signal extracted using a high pass tilted filter, the other of the at least two sets of linear prediction coefficients corresponds to a low frequency component of the speech signal extracted using a low pass tilted filter. When the speech coding system is contained within a speech codec having an encoder circuitry and a decoder circuitry, the linear prediction coefficient parameter extraction circuitry and the linear prediction coefficient combination circuitry are contained in the encoder circuitry of the speech codec.

Other aspects of the present invention can be found in a method that performs hybrid extraction of linear prediction coefficients from a speech signal. The method involves calculating a first and a second set of linear prediction coefficients from the speech signal, and combining the first set of linear prediction coefficients and the second set of linear prediction coefficients to generate a hybrid set of linear prediction coefficients.

In certain embodiments of the invention, the method further includes calculating an additional set of linear prediction coefficients from the speech signal, and combining the first set of linear prediction coefficients and the second set of linear prediction coefficients with the at least one additional set of linear prediction coefficients to generate a hybrid set of linear prediction coefficients. In addition, the method includes calculating a first set and a second set of line spectral frequencies using the linear prediction coefficients (LPCs) that are generated from the speech signal. For example, the first set of line spectral frequencies are calculated using the first set of linear prediction coefficients (LPCs), and the second set of line spectral frequencies are calculated using the second set of linear prediction coefficients (LPCs). Also, when combining the first set of linear prediction coefficients (LPCs) and the second set of linear prediction coefficients to generate a hybrid set of linear prediction coefficients (LPCs), a weighted filter is applied to the first set of linear prediction coefficients and the second set of linear prediction coefficients (LPCs).

Other aspects, advantages and novel features of the present invention will become apparent from the following detailed description of the invention when considered in conjunction with the accompanying drawings.

DETAILED DESCRIPTION OF THE INVENTION

The speech coding that is performed in accordance with the present invention is adaptable with the ITU-Recommendation speech coding standards known in the art of speech coding and speech signal processing.

Figure 1:
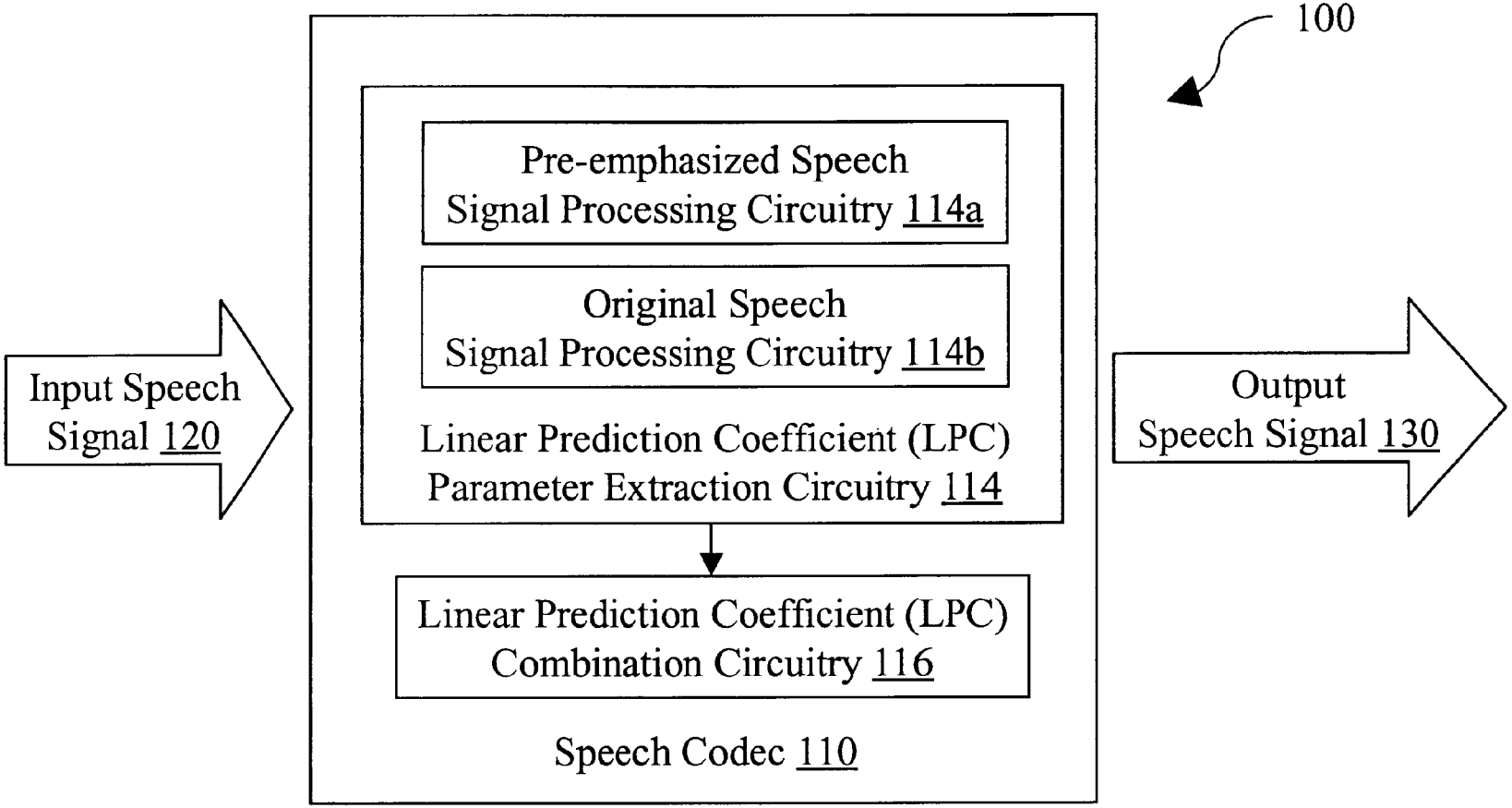
FIG. 1 is a system diagram illustrating one embodiment of a speech coding system built in accordance with the present invention.

FIG. 1 is a system diagram illustrating one embodiment of a speech coding system 100 built in accordance with the present invention. The speech coding system 100 converts an input speech signal 120 into an output speech signal 130. The speech coding system 100 performs a modified version of linear prediction speech coding on the input speech signal 120 in accordance with the present invention. Conventional linear prediction speech coding is known in the art is speech coding and speech signal processing. One example of linear prediction speech coding is code-excited linear prediction speech coding.

To perform this conversion of the input speech signal 120 to the output speech signal 130, the speech coding system 100 employs a speech codec 110. The speech codec 110 itself contains, among other things, a linear prediction coefficient (LPC) parameter extraction circuitry 114, and a linear prediction coefficient (LPC) combination circuitry 116. In one embodiment of the invention, the linear prediction coefficient (LPC) parameter extraction circuitry 114 derives two sets of linear prediction coefficient (LPC) parameters from the input speech signal by employing the well known auto-correlation method: two sets of auto-correlation coefficients are generated from the speech signal that has been preprocessed in two different ways (e.g. pre-emphasized filtering with gain in high frequency and original speech signal processing such as high-pass filtering or band pass filtering), then two sets of reflection coefficients ($K_i$) are generated using the auto-correlation coefficients, then two sets of linear prediction coefficients (LPCs) ($a_i$) are generated using the corresponding reflection coefficients ($K_i$). The linear prediction coefficient (LPC) combination circuitry 116 combines the two sets of linear prediction coefficient (LPC) parameters into one hybrid linear prediction coefficient (LPC) parameter set by converting first the two set of linear prediction coefficients (LPCs) ($a_i$) into the line spectral frequencies (LSFs), then by performing a hybrid linear combination in line spectral frequency (LSF) domain to generate a single set of line spectral frequency (LSF) parameters, and finally by converting the line spectral frequency (LSF) parameters back to the linear prediction coefficients (LPCs) ($a_i$).

In this way, the speech signal spectral information for a predetermined or selected low frequency region (e.g. from 60 Hz to 2 kHz) is represented in the linear prediction coefficient (LPC) set derived from the speech signal having been passed through the original speech signal processing circuitry, while the speech signal spectral information for a predetermined or selected high frequency region (e.g., from 2 kHz to 3.5 kHz) is better represented in the linear prediction coefficient (LPC) set derived from the speech signal having been passed through a pre-emphasize filtering circuitry which is a pre-emphasized speech signal processing circuitry 114*a* in one embodiment of the invention. The line spectral frequencies (LSFs) are used to perform linear combination as combination using line spectral frequencies (LSFs) can be more stable than performing a straightforward linear combination of the linear prediction coefficients (LPCs) in certain embodiments of the invention. Alternatively, the linear prediction coefficients (LPCs) can be linearly combined directly, but the intervening use of the line spectral frequencies (LSFs) to perform the linear combination of the linear prediction coefficients (LPCs) is operable without departing from the scope and spirit of the invention.

Other information corresponding to the input speech signal 120 is used by the linear prediction coefficient (LPC) parameter extraction circuitry 114 to generate the linear prediction coefficients (LPCs) in other embodiments of the invention. Within the linear prediction coefficient (LPC) parameter extraction circuitry 114, the pre-emphasized speech signal processing circuitry 114*a* and original speech signal processing circuitry 114*b* operate on the information that is generated or extracted from the input speech signal 120 to perform various speech coding operations on the input speech signal 120.

One example of speech coding performed on the input speech signal 120 within the linear prediction coefficient (LPC) parameter extraction circuitry 114 is the extraction of linear prediction coefficients (LPCs) themselves using linear prediction speech coding methods known in the art of speech coding and speech signal processing. Alternatively, multiple sets of linear prediction coefficients (LPCs) are extracted from the input speech signal 120 in certain embodiments of the invention. If desired, only two sets of linear prediction coefficients (LPCs) are extracted from the input speech signal 120, yet any number of sets of linear prediction coefficients (LPCs) are extracted from the input speech signal 120 in other embodiments of the invention.

The number of sets of linear prediction coefficients (LPCs) that is extracted from the input speech signal 120 is dependent upon any number of parameters or elements. For example, in the situation where only two sets of linear prediction coefficients (LPCs) are extracted from the input speech signal 120, the decision of what amount of pre-emphasize filtering (or modification) should be applied to the speech signal before extracting the linear prediction coefficients (LPCs) from the pre-emphasized speech signal is determined using the power spectral density of the input speech signal 120. Additional parameters are employed to direct the decision of how to modify the input speech signal 120 before extracting any sets of linear prediction coefficients (LPCs) including, but not limited to, other parameters known within the art of speech coding such as pitch, intensity, line spectral frequencies, and other parameters and characteristics extracted from and pertaining to the input speech signal 120.

For those embodiments of the invention where two sets of linear prediction coefficients (LPCs) are extracted from the input speech signal 120, the linear prediction coefficient (LPC) combination circuitry 116 combines the two sets of linear prediction coefficients (LPCs) into a single set of linear prediction coefficients (LPCs) corresponding to the input speech signal 120. Alternatively, for those embodiments of the invention where multiple sets of linear prediction coefficients (LPCs) are extracted from the input speech signal 120, the linear prediction coefficient (LPC) combination circuitry 116 combines the multiple sets of linear prediction coefficients (LPCs) into a single set of linear prediction coefficients (LPCs) corresponding to the input speech signal 120. From certain perspectives, the combination of the multiple sets of linear prediction coefficients (LPCs) into a single set of linear prediction coefficients (LPCs) constitutes generating a hybrid set of linear prediction coefficients ($LPC_{hybrid}$) for the input speech signal 120.

If desired, the linear prediction coefficient (LPC) combination circuitry 116 combines the multiple sets of linear prediction coefficients (LPCs) into a number of sets of linear prediction coefficients (LPCs) wherein the number of sets of linear prediction coefficients (LPCs) is less than the multiple sets of linear prediction coefficients (LPCs), i.e., the linear prediction coefficient (LPC) combination circuitry 116 decreases the number of sets of linear prediction coefficients (LPCs) without reducing strictly to a single set of linear prediction coefficients (LPCs), but merely decreases the number of sets of linear prediction coefficients (LPCs) by a predetermined amount.

Figure 2:
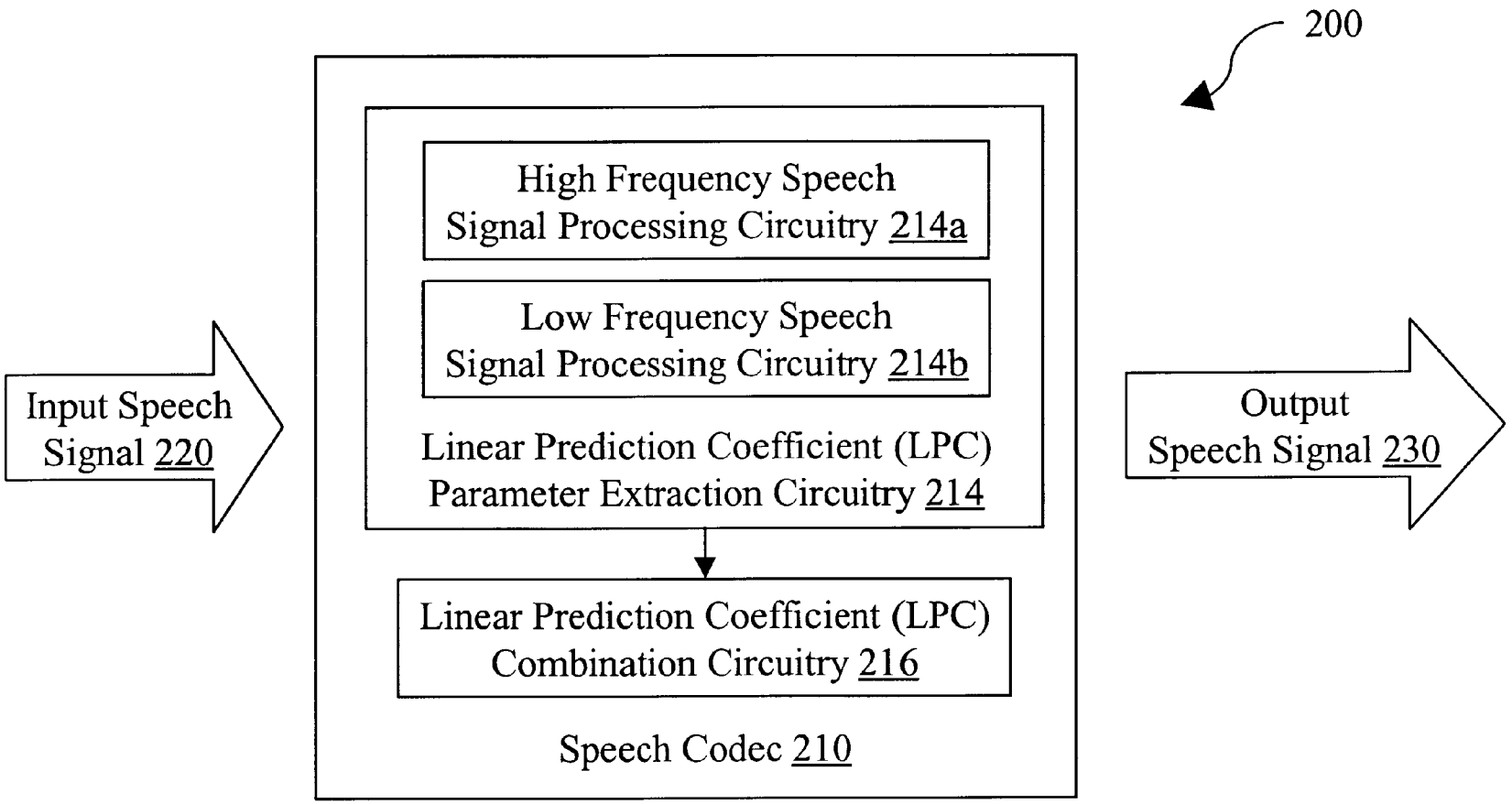
FIG. 2 is a system diagram illustrating another embodiment of a speech coding system built in accordance with the present invention.

FIG. 2 is a system diagram illustrating another embodiment of a speech coding system 200 built in accordance with the present invention. The speech coding system 200 converts an input speech signal 220 into an output speech signal 230. To perform this conversion of the input speech signal 220 to the output speech signal 230, the speech coding system 200 employs a speech codec 210. The speech codec 210 itself contains, among other things, a linear prediction coefficient (LPC) parameter extraction circuitry 214, and a linear prediction coefficient (LPC) combination circuitry 216.

The linear prediction coefficient (LPC) parameter extraction circuitry 214 receives line spectral frequency (LSF) information that is generated from the input speech signal 220. Within the linear prediction coefficient (LPC) parameter extraction circuitry 214, a high frequency speech signal processing circuitry 214*a* and a low frequency speech signal processing circuitry 214*b* operate on the speech signal 220 to generate line spectral frequency information to perform various speech coding operations on the input speech signal 220. Line spectral frequency (LSF) extraction is known to those skilled in the art is speech coding, yet the manner of combination performed in accordance with the present invention presents a novel way to generate a single set of linear prediction coefficients (LPCs) more representative of the entire speech signal 220.

Similar the embodiment of the invention illustrated in the FIG. 1 that employs the linear prediction coefficient (LPC) parameter extraction circuitry 114, the linear prediction coefficient (LPC) parameter extraction circuitry 214 of the FIG. 2 is operable to derive two sets of linear prediction coefficient (LPC) parameters from the input speech signal by employing the well known autocorrelation method: two sets of auto-correlation coefficients are generated from the speech signal that has been preprocessed in two different ways (e.g. pre-emphasized filtering with gain in high frequency and original speech signal processing such as high-pass filtering or band pass filtering), then two sets of reflection coefficients ($K_i$) are generated using the auto-correlation coefficients, then two sets of linear prediction coefficients (LPCs) ($a_i$) are generated using the corresponding reflection coefficients ($K_i$). The linear prediction coefficient (LPC) combination circuitry 216 combines the two sets of linear prediction coefficient (LPC) parameters into one hybrid linear prediction coefficient (LPC) parameter set by converting first the two set of linear prediction coefficients (LPCs) ($a_i$) into the line spectral frequencies (LSFs), then by performing a hybrid linear combination in line spectral frequency (LSF) domain to generate a single set of line spectral frequency (LSF) parameters, and finally by converting the line spectral frequency (LSF) parameters back to the linear prediction coefficients (LPCs) ($a_i$) to generate the one hybrid linear prediction coefficient (LPC) parameter set.

In this way, the speech signal spectral information for a predetermined or selected low frequency region (e.g. from 60 Hz to 2 kHz) is represented in the linear prediction coefficient (LPC) set that is derived from the speech signal using the low frequency speech signal processing circuitry 214*b*, while the speech signal spectral information for a predetermined or selected high frequency region (e.g., from 2 kHz to 3.5 kHz) is better represented in the linear prediction coefficient (LPC) set that is derived from the speech signal using the high frequency speech signal processing circuitry 214*a*. The line spectral frequencies (LSFs) are used to perform linear combination as combination using line spectral frequencies (LSFs) can be more stable than performing a straightforward linear combination of the linear prediction coefficients (LPCs) in certain embodiments of the invention. Alternatively, the linear prediction coefficients (LPCs) can be linearly combined directly, but the intervening use of the line spectral frequencies (LSFs) to perform the linear combination of the linear prediction coefficients (LPCs) is operable without departing from the scope and spirit of the invention.

In the specific embodiment shown by the speech coding system 200 in the FIG. 2, the input speech signal 220 is partitioned, from certain perspectives, into a high frequency component and a low frequency component. This partition is achieved using the high frequency speech signal processing circuitry 214*a* and the low frequency speech signal processing circuitry 214*b*. To perform the partition of the input speech signal 220 into a high frequency component and a low frequency component, a low pass tilted filter and a high pass tilted filter are used to perform filtering on the input speech signal 220. That is to say, the low pass tilted filter and the high pass tilted filter are not per se a low pass filter of a high pass filter, but a modified low pass filter and a modified high pass filter where the rejection band spectrum is not entirely cut off, but rather attenuated by a predetermined amount which itself may be a function of frequency. For example, a low pass tilted filter may have a predetermined attenuation of a certain dB value below its "cutoff" frequency, but the frequencies below that traditional "cutoff" frequency are only attenuated, and not cut off completely. This way of partitioning the input speech signal 220 into a high frequency component and a low frequency component is amenable within the present invention.

Each of the high frequency component and a low frequency component of the input speech signal 220 is treated independently during speech coding of the input speech signal 220 and then a final combination is performed to perform speech coding on the speech signal 220. If desired, the high frequency component of the input speech signal 220 is further partitioned into a number of components, and the low frequency component of the speech signal segment 220 is further partitioned into a number of components. In this embodiment, the high frequency speech signal processing circuitry 214*a* operates on the high frequency component of the input speech signal 220, and the low frequency speech signal processing circuitry 214*b* operates on the low frequency component of the input speech signal 220.

One example of speech coding performed on the input speech signal 220 within the linear prediction coefficient (LPC) parameter extraction circuitry 214 are the extraction of linear prediction coefficients (LPCs) themselves using linear prediction speech coding methods known in the art. Alternatively, multiple sets of linear prediction coefficients (LPCs) are extracted from the input speech signal 220 in certain embodiments of the invention. If desired, only two sets of linear prediction coefficients (LPCs) are extracted from the input speech signal 220, yet any number of sets of linear prediction coefficients (LPCs) are extracted from the input speech signal 220 in other embodiments of the invention. Also, the number of sets of linear prediction coefficients (LPCs) that are extracted from the input speech signal 220 is a function of components into which the input speech signal 220 is partitioned using the high frequency speech signal processing circuitry 214*a* and the low frequency speech signal processing circuitry 214*b* in accordance with the present invention as described above. For example, one set of linear prediction coefficients (LPCs) is generated for each of the low frequency component of the input speech signal 220 and the high frequency component of the input speech signal 220. In addition, for those cases where each of the low frequency component of the input speech signal 220 and the high frequency component of the input speech signal 220 is further partitioned into a number of components, an individual set of linear prediction coefficients (LPCs) is calculated for each of the number of components within each of the low frequency component of the input speech signal 220 and the high frequency component of the input speech signal 220.

The number of sets of linear prediction coefficients (LPCs) that are extracted from the input speech signal 220 is dependent upon any number of parameters or elements. For example, in the situation where only two sets of linear prediction coefficients (LPCs) are extracted from the input speech signal 220, the decision of what amount of pre-emphasize filtering (or modification) should be applied to the speech signal before extracting the linear prediction coefficients (LPCs) from the pre-emphasized speech signal is determined using the power spectral density of the input speech signal 220. Additional parameters are employed to direct the decision of how to modify the input speech signal 220 before extracting any sets of linear prediction coefficients (LPCs) including, but not limited to, other parameters known within the art of speech coding such as pitch, intensity, line spectral frequencies, and other parameters and characteristics extracted from and pertaining to the input speech signal 220.

For those embodiments of the invention where two sets of linear prediction coefficients (LPCs) are extracted from the input speech signal 220, the linear prediction coefficient (LPC) combination circuitry 216 combines the two sets of linear prediction coefficients (LPCs) into a single set of linear prediction coefficients (LPCs) corresponding to the input speech signal 220. If desired, the intervening use of line spectral frequencies, derived from each of the two sets of linear prediction coefficients (LPCs), are used to perform the linear combination of the two sets of the linear prediction coefficients (LPCs) into a single set of linear prediction coefficients (LPCs). For example, the generation of line spectral frequencies (LSFs) is performed using the two sets of linear prediction coefficients (LPCs) as described above in various embodiments of the invention. However, the linear combination of the two sets of linear prediction coefficients (LPCs) could nevertheless performed in a straightforward manner in certain embodiments of the invention.

In addition, for those embodiments of the invention where multiple sets of linear prediction coefficients (LPCs) are extracted from the input speech signal 220, the linear prediction coefficient (LPC) combination circuitry 216 combines the multiple sets of linear prediction coefficients (LPCs) into a single set of linear prediction coefficients (LPCs) corresponding to the input speech signal 220. From certain perspectives, the combination of the multiple sets of linear prediction coefficients (LPCs) into a single set of linear prediction coefficients (LPCs) constitutes generating a hybrid set of linear prediction coefficients (LPCs) for the input speech signal 220.

If desired, the linear prediction coefficient (LPC) combination circuitry 216 combines the multiple sets of linear prediction coefficients (LPCs) into a number of sets of linear prediction coefficients (LPCs) wherein the number of sets of linear prediction coefficients (LPCs) is less than the multiple sets of linear prediction coefficients (LPCs), i.e., the linear prediction coefficient (LPC) combination circuitry 216 decreases the number of sets of linear prediction coefficients (LPCs) without reducing strictly to a single set of linear prediction coefficients (LPCs), but merely decreases the number of sets of linear prediction coefficients (LPCs) by a predetermined amount.

Figure 3:
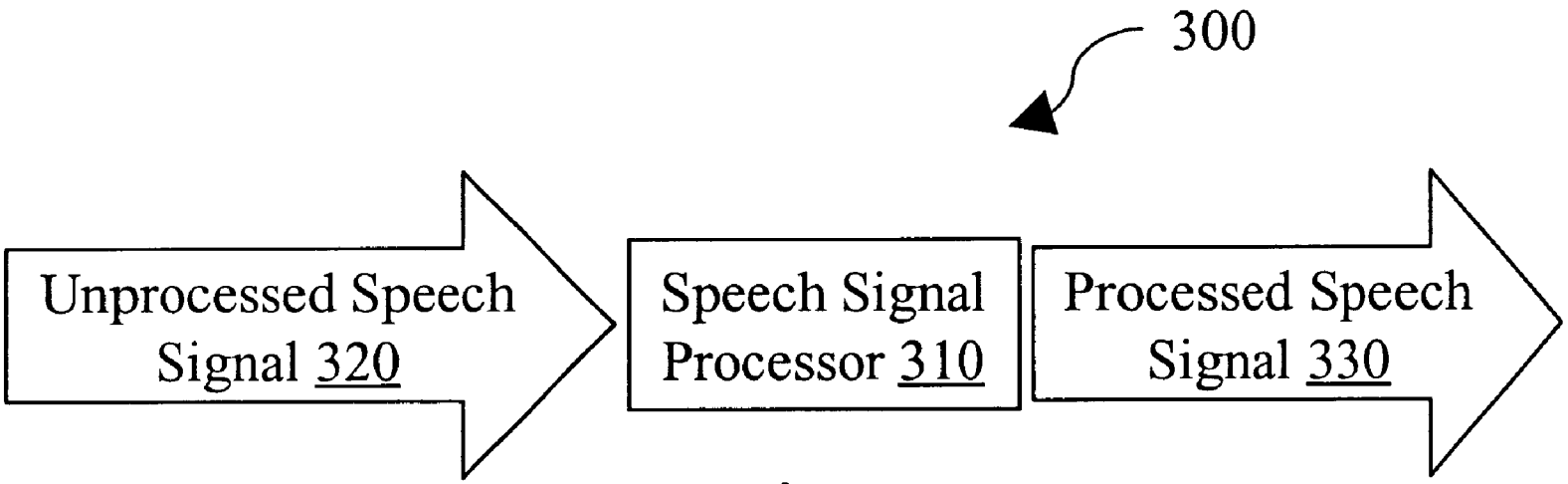
FIG. 3 is a system diagram illustrating an embodiment of a speech signal processing system built in accordance with the present invention.

FIG. 3 is a system diagram illustrating an embodiment of a speech signal processing system 300 built in accordance with the present invention. The speech signal processor 310 receives an unprocessed speech signal 320 and produces a processed speech signal 330.

In certain embodiments of the invention, the speech signal processor 310 is processing circuitry that performs the loading of the unprocessed speech signal 320 into a memory from which selected portions of the unprocessed speech signal 320 are processed in various manners including a sequential manner. The processing circuitry possesses insufficient processing capability to handle the entirety of the unprocessed speech signal 320 at a single, given time. The processing circuitry may employ any method known in the art that transfers data from a memory for processing and returns the processed speech signal 330 to the memory. In other embodiments of the invention, the speech signal processor 310 is a system that converts a speech signal into encoded speech data. The encoded speech data is then used to generate a reproduced speech signal that is substantially perceptually indistinguishable from the speech signal using speech reproduction circuitry. In other embodiments of the invention, the speech signal processor 310 is a system that converts encoded speech data, represented as the unprocessed speech signal 320, into decoded and reproduced speech data, represented as the processed speech signal 330. In other embodiments of the invention, the speech signal processor 310 converts encoded speech data that is already in a form suitable for generating a reproduced speech signal that is substantially perceptually indistinguishable from the speech signal, yet additional processing is performed to improve the perceptual quality of the encoded speech data for reproduction.

The speech signal processing system 300 is, in some embodiments, the speech codec 100, or, alternatively, the speech codec 200 as described in the FIGS. 1 and 2, respectively. The speech signal processor 310 operates to convert the unprocessed speech signal 320 into the processed speech signal 330. The conversion performed by the speech signal processor 310 is viewed, in various embodiments of the invention, as taking place at any interface wherein data must be converted from one form to another, i.e. from speech data to coded speech data, from coded data to a reproduced speech signal, etc. The speech coding performed in accordance with the present invention is performed, in various embodiments of the invention, within the speech signal processor 310. From certain perspectives, the conversion of the unprocessed speech signal 320 into the processed speech signal 330 is the extraction of the linear prediction coefficients (LPCs) and the combination of the linear prediction coefficients (LPCs), as described above in the various embodiments of the invention.

Figure 4:
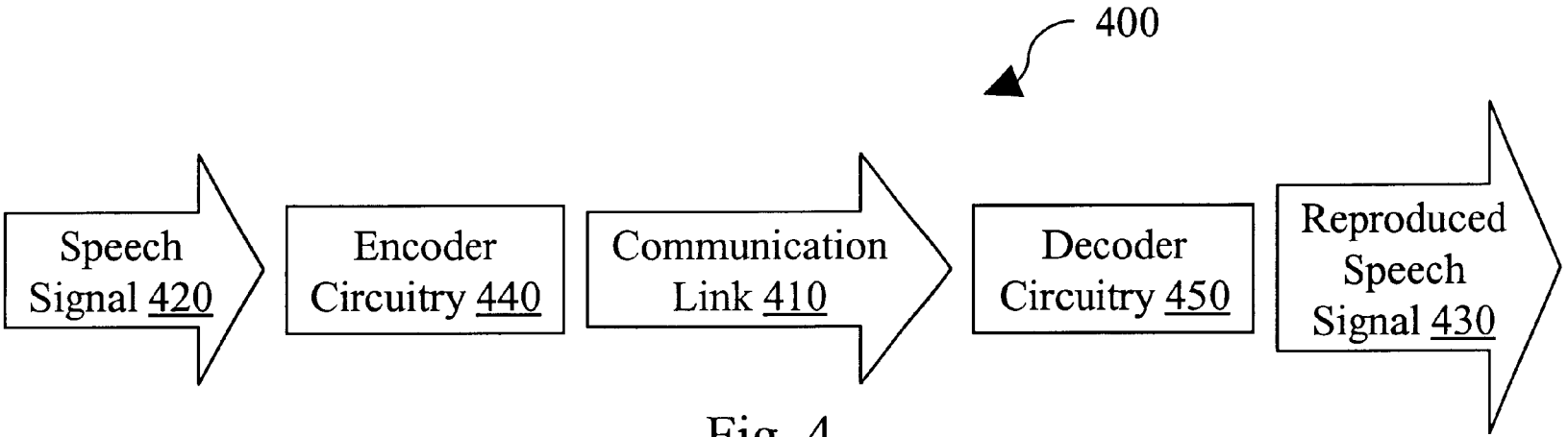
FIG. 4 is a system diagram illustrating an embodiment of a speech codec built in accordance with the present invention that communicates using a communication link.

FIG. 4 is a system diagram illustrating an embodiment of a speech codec 400 built in accordance with the present invention that communicates across a communication link 410. A speech signal 420 is input into an encoder circuitry 440 in which it is coded for data transmission via the communication link .410 to a decoder circuitry 450. The decoder processing circuit 450 converts the coded data to generate a reproduced speech signal 430 that is substantially perceptually indistinguishable from the speech signal 420.

The speech coding performed in accordance with the present invention is performed, in various embodiments of the invention, in the encoder circuitry 440 or alternatively, in the decoder circuitry 450. If desired, a portion of the speech coding is performed in the encoder circuitry 440, and another portion of the speech coding of the speech signal is performed in the decoder circuitry 450 of the speech codec 400. That is to say, for example, the extraction of the linear prediction coefficients (LPCs), in accordance with the various embodiments of the invention described above, is performed exclusively in the encoder circuitry 440, or alternatively, exclusively in the decoder circuitry 450 of the speech codec 400. Moreover, the extraction of the linear prediction coefficients (LPCs) is performed partially in the encoder circuitry 440 and partially in the decoder circuitry 450 in other embodiments of the invention. Similarly, the combination of sets of linear prediction coefficients (LPCs) is performed, in certain embodiments of the invention, is performed exclusively in the encoder circuitry 440, or alternatively, exclusively in the decoder circuitry 450 of the speech codec 400. Moreover, the combination of sets of linear prediction coefficients (LPCs) is performed partially in the encoder circuitry 440 and partially in the decoder circuitry 450 in other embodiments of the invention.

In certain embodiments of the invention, the decoder circuitry 450 includes speech reproduction circuitry. Similarly, the encoder circuitry 440 includes selection circuitry that is operable to select from a plurality of coding modes. The communication link 410 is either a wireless or a wireline communication link without departing from the scope and spirit of the invention. In addition, the communication link 410 is a network capable of handling the transmission of speech signals in other embodiments of the invention. Examples of such networks include, but are not limited to, Internet and intra-net networks capable of handling such transmission. If desired, the encoder circuitry 440 identifies at least one perceptual characteristic of the speech signal and selects an appropriate speech signal coding scheme depending on the at least one perceptual characteristic. The speech codec 400 is, in one embodiment, a multi-rate speech codec that performs speech coding on the speech signal 420 using the encoder circuitry 440 and the decoder circuitry 450. The speech codec 400 is operable to perform hybrid extraction of linear prediction coefficients as a function of frequency within speech data in accordance with the present invention.

Figure 5:
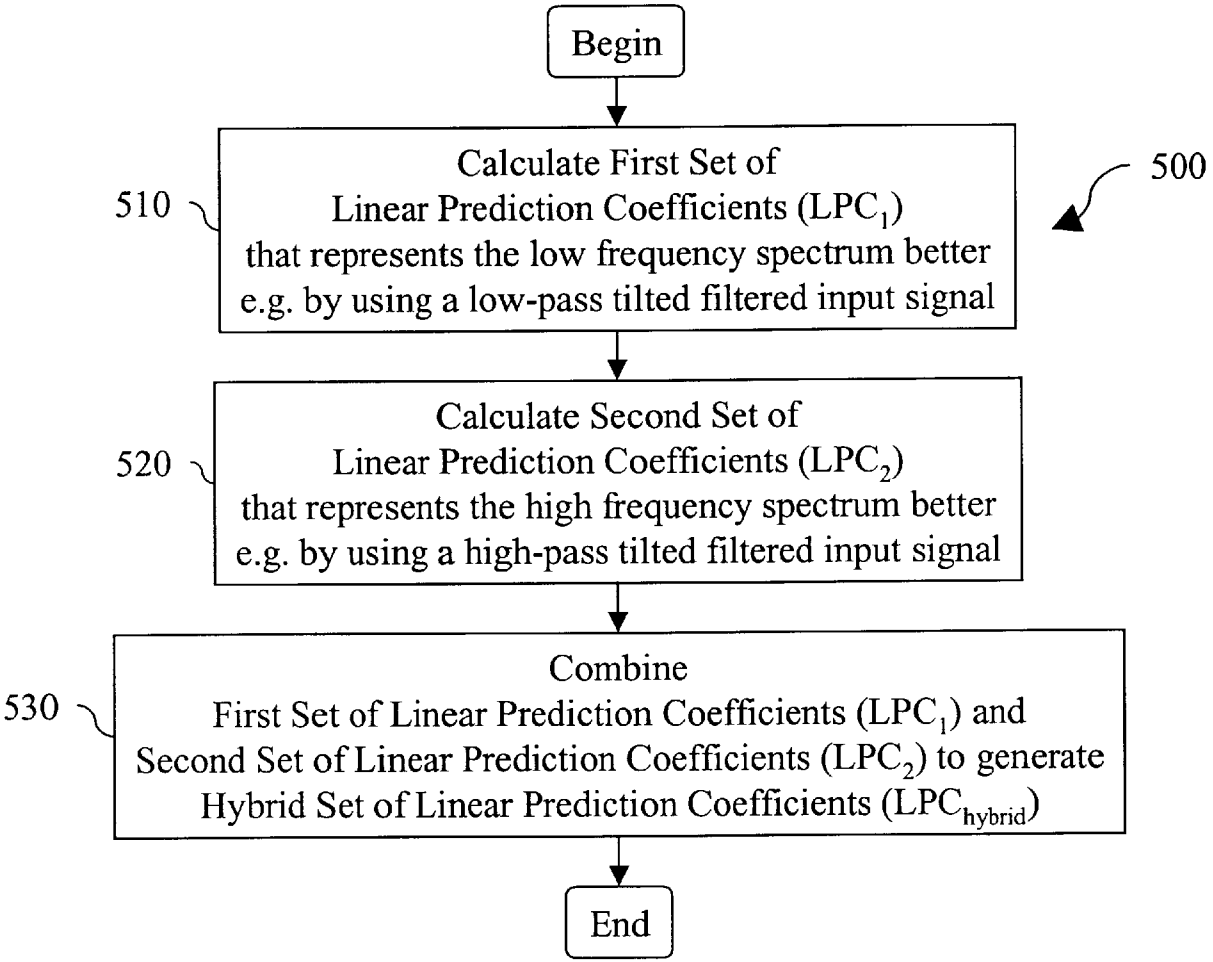
FIG. 5 is a functional block diagram illustrating an embodiment of a speech coding method performed in accordance with the present invention that calculates and combines two sets of linear prediction coefficients.

FIG. 5 is a functional block diagram illustrating an embodiment of a speech coding method 500 performed in accordance with the present invention that calculates and combines two sets of linear prediction coefficients. In a block 510, a first set of linear prediction coefficients ($LPC_1$) is calculated that corresponds to a speech signal. The first set of linear prediction coefficients ($LPC_1$) of the block 510 represents the low frequency spectrum of the speech signal. This representation is achieved, among other ways, by employing a low pass tilted filter to the speech signal. As described above in various embodiments of the invention, the low pass tilted filter need not be a per se low pass filter, but a modified low pass filter that attenuates the frequencies above the "cutoff" frequency by a predetermined amount, which may itself be a function of frequency, yet those frequencies are not completely rejected. For example, the attenuation above the "cutoff" frequency is a predetermined amount of dB in certain embodiments of the invention, whereas the frequencies below the "cutoff" frequency are passed. This is in contrast to a traditional low pass filter where frequencies below the "cutoff" frequency are passed, and the frequencies above the "cutoff" frequency are rejected.

Subsequently, in a block 520, a second set of linear prediction coefficients ($LPC_2$) is calculated. The second set of linear prediction coefficients ($LPC_2$) of the block 520 represents the high frequency spectrum of the speech signal. This representation is achieved, among other ways, by employing a high pass tilted filter to the speech signal. As described above in various embodiments of the invention, the high pass tilted filter need not be a per se high pass filter, but a modified high pass filter that attenuates the frequencies below the "cutoff" frequency by a predetermined amount, which may itself be a function of frequency yet those frequencies are not completely rejected. For example, the attenuation below the "cutoff" frequency is a predetermined amount of dB in certain embodiments of the invention, whereas the frequencies above the "cutoff" frequency are passed. This is in contrast to a traditional high pass filter where frequencies above the "cutoff" frequency are passed, and the frequencies below the "cutoff" frequency are rejected.

After each of the first set of linear prediction coefficients ($LPC_1$) and the second set of linear prediction coefficients ($LPC_2$) are calculated in each of the blocks 510 and 520, respectively, the first set of linear prediction coefficients ($LPC_1$) and the second set of linear prediction coefficients ($LPC_2$) are combined in a block 530. If desired, the first set of linear prediction coefficients ($LPC_1$) and the second set of linear prediction coefficients ($LPC_2$) are combined into a single set of linear prediction coefficients (LPCs). From certain perspectives, the single set of linear prediction coefficients (LPCs) is a hybrid set of linear prediction coefficients ($LPC_{hybrid}$).

From certain perspectives, the combination of the first set of linear prediction coefficients ($LPC_1$) and the second set of linear prediction coefficients ($LPC_2$) are combined into a single set of linear prediction coefficients (LPCs) that provides for a greater perceptually quality of a reproduced speech signal than if a single set of linear prediction coefficients (LPCs) is generated immediately from an input speech signal, without having first generated each of the first set of linear prediction coefficients ($LPC_1$) and the second set of linear prediction coefficients ($LPC_2$) from the input speech signal. That is to say, the decision of how to partition an input speech signal is appropriately chosen such that the first set of linear prediction coefficients ($LPC_1$) is directed substantially to maximize a perceptual quality of a first portion of the input speech signal, and the second set of linear prediction coefficients ($LPC_2$) is directed substantially to maximize a perceptual quality of a second portion of the input speech signal. In certain embodiments of the invention, the first portion of the input speech signal and the second portion of the input speech signal correspond to a high frequency component of the input speech signal and a low frequency component of the input speech signal, each of which is best represented by the first set of linear prediction coefficients ($LPC_1$) and the second set of linear prediction coefficients ($LPC_2$), respectively. In other embodiments of the invention, the first portion of the input speech signal and the second portion of the input speech signal correspond to a high energy component of the input speech signal and a low energy component of the input speech signal.

Figure 6:
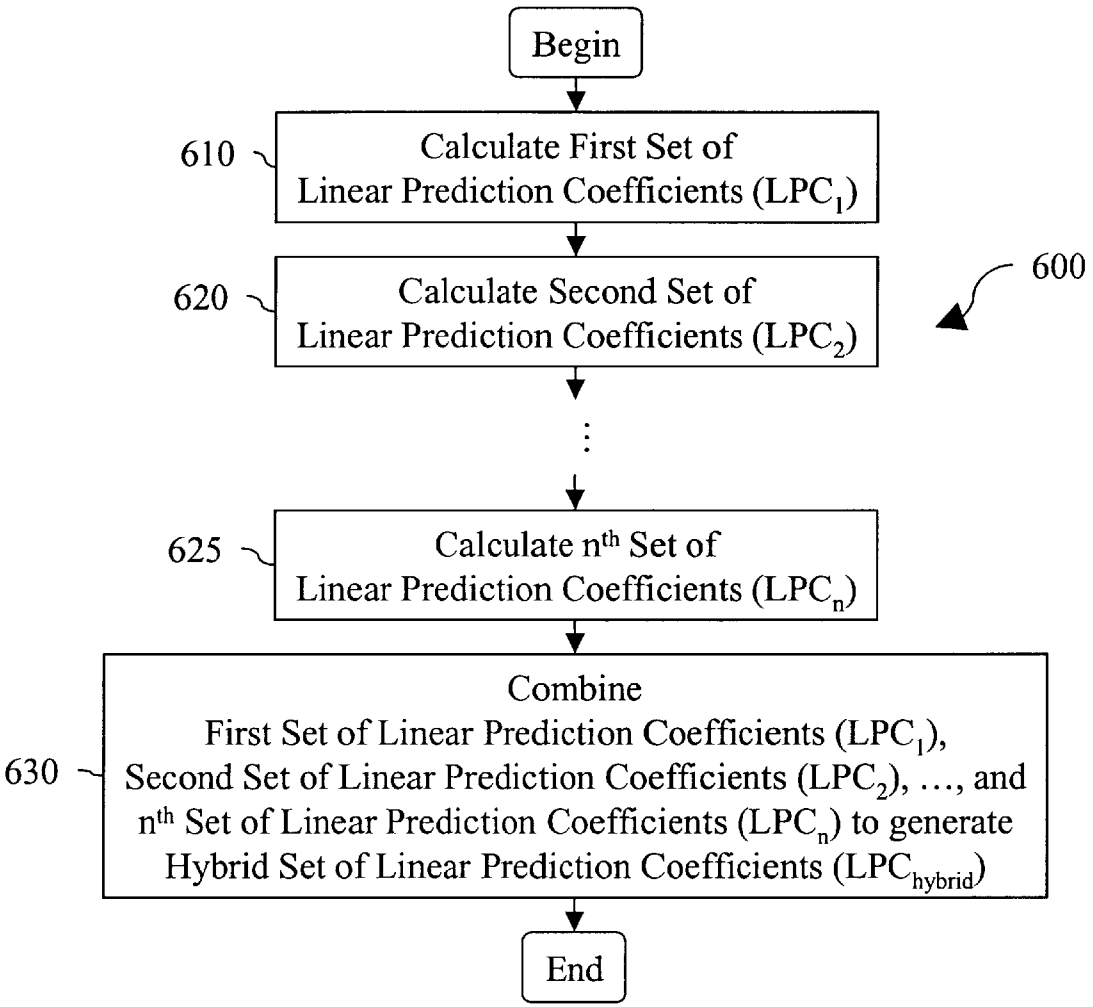
FIG. 6 is a functional block diagram illustrating an embodiment of a speech coding method performed in accordance with the present invention that calculates and combines an indefinite number of sets of linear prediction coefficients corresponding to an input speech signal.

FIG. 6 is a functional block diagram illustrating an embodiment of a speech coding method 600 performed in accordance with the present invention that calculates and combines an indefinite number of sets of linear prediction coefficients corresponding to an input speech signal.

In a block 610, a first set of linear prediction coefficients ($LPC_1$) is calculated. Subsequently, in a block 620, a second set of linear prediction coefficients ($LPC_2$) is calculated, and in a block 625, an $n^{th}$ set of linear prediction coefficients ($LPC_n$) is calculated. If desired, each of the first set of linear prediction coefficients ($LPC_1$), the second set of linear prediction coefficients ($LPC_2$) and the $n^{th}$ set of linear prediction coefficients ($LPC_n$) of the blocks 610, 620, and 625, are derived using a predetermined filtering method. Specific examples of filtering include applying a low pass tilted filter or a high pass tilted filter to the various portions of a speech signal. As shown in the embodiment of the speech coding method 500 in FIG. 5, various types of filtering are applied to various portions of the speech signal in order to maximize certain perceptual qualities of those portions of the speech signal. Similarly, as desired in the specific application, the first set of linear prediction coefficients ($LPC_1$), the second set of linear prediction coefficients ($LPC_2$) and the $n^{th}$ set of linear prediction coefficients ($LPC_n$) of the blocks 610, 620, and 625 are tailored to maximize certain perceptual characteristics of certain portions of the speech signal in various embodiments of the invention.

After each of the first set of linear prediction coefficients ($LPC_1$), the second set of linear prediction coefficients ($LPC_2$), and the $n^{th}$ set of linear prediction coefficients ($LPC_n$) are calculated in each of the blocks 610, 620, and 625, respectively, the first set of linear prediction coefficients ($LPC_1$), the second set of linear prediction coefficients ($LPC_2$), and the $n^{th}$ set of linear prediction coefficients ($LPC_n$), are combined in a block 630. If desired, the first set of linear prediction coefficients ($LPC_1$), the second set of linear prediction coefficients ($LPC_2$), and the $n^{th}$ set of linear prediction coefficients ($LPC_n$), are combined into a single set of linear prediction coefficients (LPCs). From certain perspectives, the single set of linear prediction coefficients (LPCs) is a hybrid set of linear prediction coefficients ($LPC_{hybrid}$).

From certain perspectives, the combination of the first set of linear prediction coefficients ($LPC_1$), the second set of linear prediction coefficients ($LPC_2$), and the $n^{th}$ set of linear prediction coefficients ($LPC_n$) are combined into a single set of linear prediction coefficients (LPCs) that provides for a greater perceptually quality of a reproduced speech signal than if a single set of linear prediction coefficients (LPCs) is generated immediately from an input speech signal, without having first generated each of the first set of linear prediction coefficients ($LPC_1$), the second set of linear prediction coefficients ($LPC_2$), and the $n^{th}$ set of linear prediction coefficients ($LPC_n$) from the input speech signal. That is to say, the decision of how to partition an input speech signal is appropriately chosen such that the first set of linear prediction coefficients ($LPC_1$) is directed substantially to maximize a perceptual quality of a first portion of the input speech signal; the second set of linear prediction coefficients ($LPC_2$) is directed substantially to maximize a perceptual quality of a second portion of the input speech signal; and the $n^{th}$ set of linear prediction coefficients ($LPC_n$) is directed substantially to maximize a perceptual quality of an $n^{th}$ portion of the input speech signal.

In certain embodiments of the invention, the first portion of the input speech signal corresponds to a first frequency component of the input speech signal. The second portion of the input speech signal corresponds to a second frequency component of the input speech signal, and the $n^{th}$ portion of the input speech signal corresponds to an $n^{th}$ frequency component of the input speech signal. In other embodiments of the invention, the first portion of the input speech signal corresponds to a first energy component of the input speech signal. The second portion of the input speech signal corresponds to a second energy component of the input speech signal, and the $n^{th}$ portion of the input speech signal corresponds to an $n^{th}$ energy component of the input speech signal.

Figure 7:
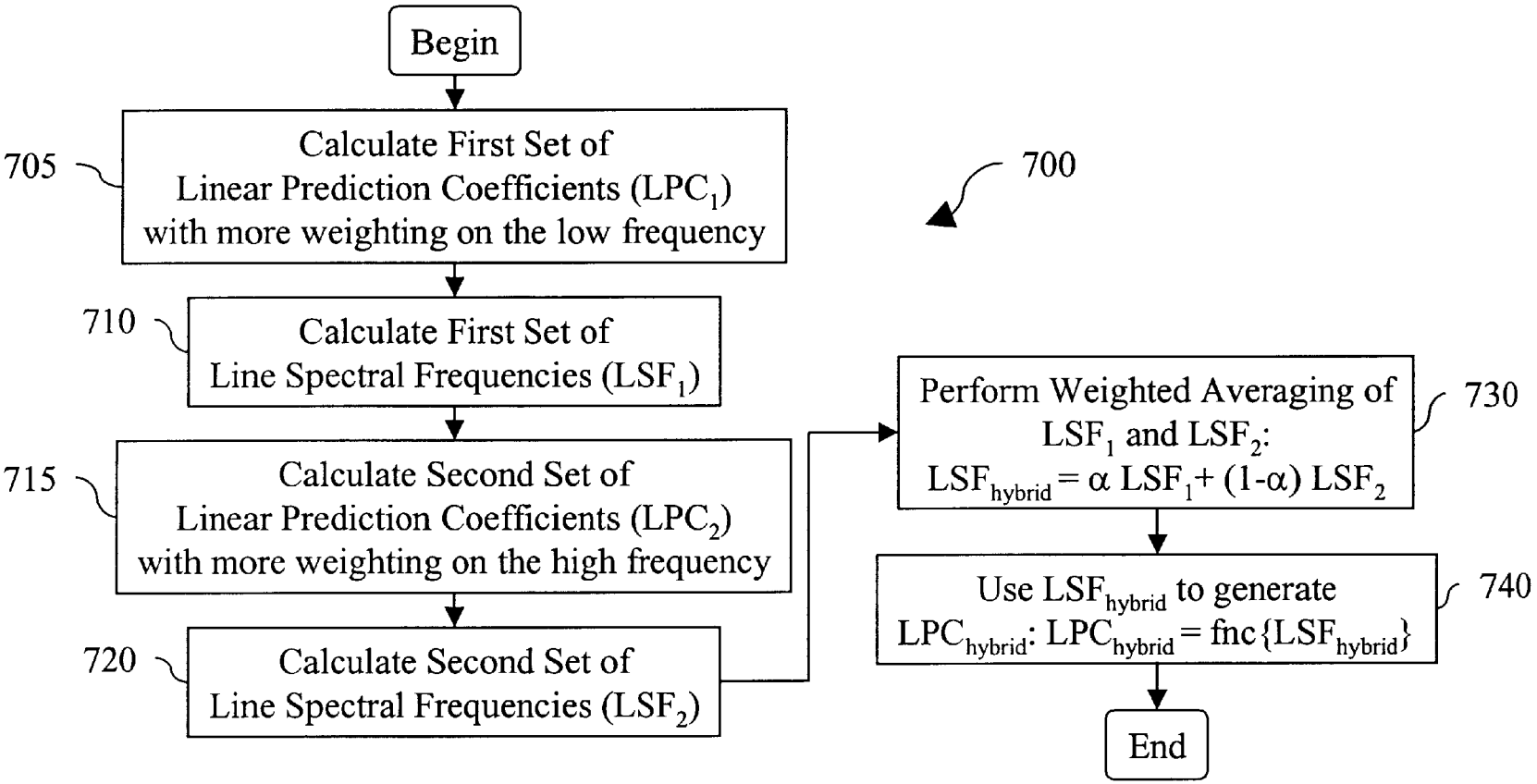
FIG. 7 is a functional block diagram illustrating an embodiment of a speech coding method that calculates line spectral frequencies corresponding to two sets of linear prediction coefficients and uses the line spectral frequencies to generate a hybrid set of linear prediction coefficients corresponding to an input speech signal.

FIG. 7 is a functional block diagram illustrating an embodiment of a speech coding method 700 that calculates line spectral frequencies corresponding to two sets of linear prediction coefficients and uses the line spectral frequencies to generate a hybrid set of linear prediction coefficients corresponding to an input speech signal.

In a block 705, a first set of linear prediction coefficients ($LPC_1$) is calculated using more weighting on the low frequency components of the speech signal. If desired, a low pass tilted filter is used to perform the weighting on the low frequency components of the speech signal in certain embodiments of the invention as similarly shown in certain aspects of the speech coding method 500 illustrated in FIG. 5 dealing with applying a low pass tilted filter to the speech signal. For the first set of linear prediction coefficients ($LPC_1$) that is calculated in the block 705, a first set of line spectral frequencies ($LSF_1$) is calculated is calculated in a block 710. Extracting line spectral frequencies from a speech signal is known in the art of speech signal processing.

The first set of line spectral frequencies ($LSF_1$) is calculated using the first set of linear prediction coefficients ($LPC_1$). In one embodiment of the invention, a number of auto-correlation coefficients are generated from the speech signal, then a number of reflection coefficients ($K_i$) are generated using the auto-correlation coefficients, then first set of linear prediction coefficients ($LPC_1$) are generated using the number of reflection coefficients ($K_i$), and finally the first set of line spectral frequencies ($LSF_1$) is generated using the first set of linear prediction coefficients ($LPC_1$). In this way, the generation of the first set of line spectral frequencies ($LSF_1$) is derivative from the first set of linear prediction coefficients ($LPC_1$).

Subsequently, in a block 715, a second set of linear prediction coefficients ($LPC_2$) is calculated using more weighting on the high frequency components of the speech signal. If desired, a high pass tilted filter is used to perform the weighting on the high frequency components of the speech signal in certain embodiments of the invention as similarly shown in certain aspects of the speech coding method 500 illustrated in FIG. 5 dealing with applying a high pass tilted filter to the speech signal. For the second set of linear prediction coefficients ($LPC_1$) that is calculated in the block 715, a second set of line spectral frequencies ($LSF_2$) is calculated is calculated in a block 720.

In one embodiment of the invention, a number of auto-correlation coefficients are generated from the speech signal, then a number of reflection coefficients ($K_i$) are generated using the auto-correlation coefficients, then second set of linear prediction coefficients ($LPC_2$) are generated using the number of reflection coefficients ($K_i$), and finally the second set of line spectral frequencies ($LSF_2$) is generated using the second set of linear prediction coefficients ($LPC_2$). In this way, the generation of the second set of line spectral frequencies ($LSF_s$) is derivative from the second set of linear prediction coefficients ($LPC_s$).

After each of the first set of line spectral frequencies ($LSF_1$) and the second set of line spectral frequencies ($LSF_2$) are calculated in each of the blocks 710 and 720 corresponding to the first set of linear prediction coefficients ($LPC_1$) and the second set of linear prediction coefficients ($LPC_2$) that are calculated in the blocks 705 and 715, respectively, the first set of line spectral frequencies ($LSF_1$) and the second set of line spectral frequencies ($LSF_2$) are combined in a block 730 using a weighted averaging as shown below in one embodiment of the invention.

$$LSF_{hybrid}=\alpha\, LSF_1+(1-\alpha)LSF_2$$

The particular value of the weighting parameter "α" that is used to perform the weighted averaging of the first set of line spectral frequencies ($LSF_1$) and the second set of line spectral frequencies ($LSF_2$) is defined by the user employing the speech coding method 700. If desired, the weighting parameter "α" is adaptively adjusted to various parameters of the speech signal and the weighting of various portions of the speech signal is modified as a function of the speech signal.

In a more general form, the weighting parameter "α" should be seen as a parameter set (a vector) with the same dimension as the LSF parameter sets, i.e.:

$$(LSF_{hybrid})_i=\alpha_i(LSF_1)_i+(1-\alpha_i)(LSF_2)_i$$

where i=1, . . . , LPC_order

In this embodiment of the invention, the first set of line spectral frequencies ($LSF_1$) and the second set of line spectral frequencies ($LSF_2$) are combined into a single, hybrid set of line spectral frequencies ($LSF_{hybrid}$) in the block 730. Then, in a block 740, a single, hybrid set of linear prediction coefficients ($LPC_{hybrid}$) is generated from the input speech signal using the single, hybrid set of line spectral frequencies ($LSF_{hybrid}$) that is generated in the block 730. From certain perspectives, the hybrid set of linear prediction coefficients ($LPC_{hybrid}$) of the block 740 is a function of the hybrid set of line spectral frequencies ($LSF_{hybrid}$) of the block 730.

$$LPC_{hybrid}=fnc\{LSF_{hybrid}\}$$

The two sets of line spectral frequencies (LSFs) (the first set of line spectral frequencies ($LSF_1$) and the second set of line spectral frequencies ($LSF_2$)) are used to perform linear combination as combination using line spectral frequencies (LSFs) can be more stable than performing a straightforward linear combination of the linear prediction coefficients (LPCs) in certain embodiments of the invention. Alternatively, the linear prediction coefficients (LPCs) can be linearly combined directly as shown above in the various embodiments of the invention, but the intervening use of the line spectral frequencies (LSFs) to perform the linear combination of the linear prediction coefficients (LPCs) is operable without departing from the scope and spirit of the invention.

Figure 8:
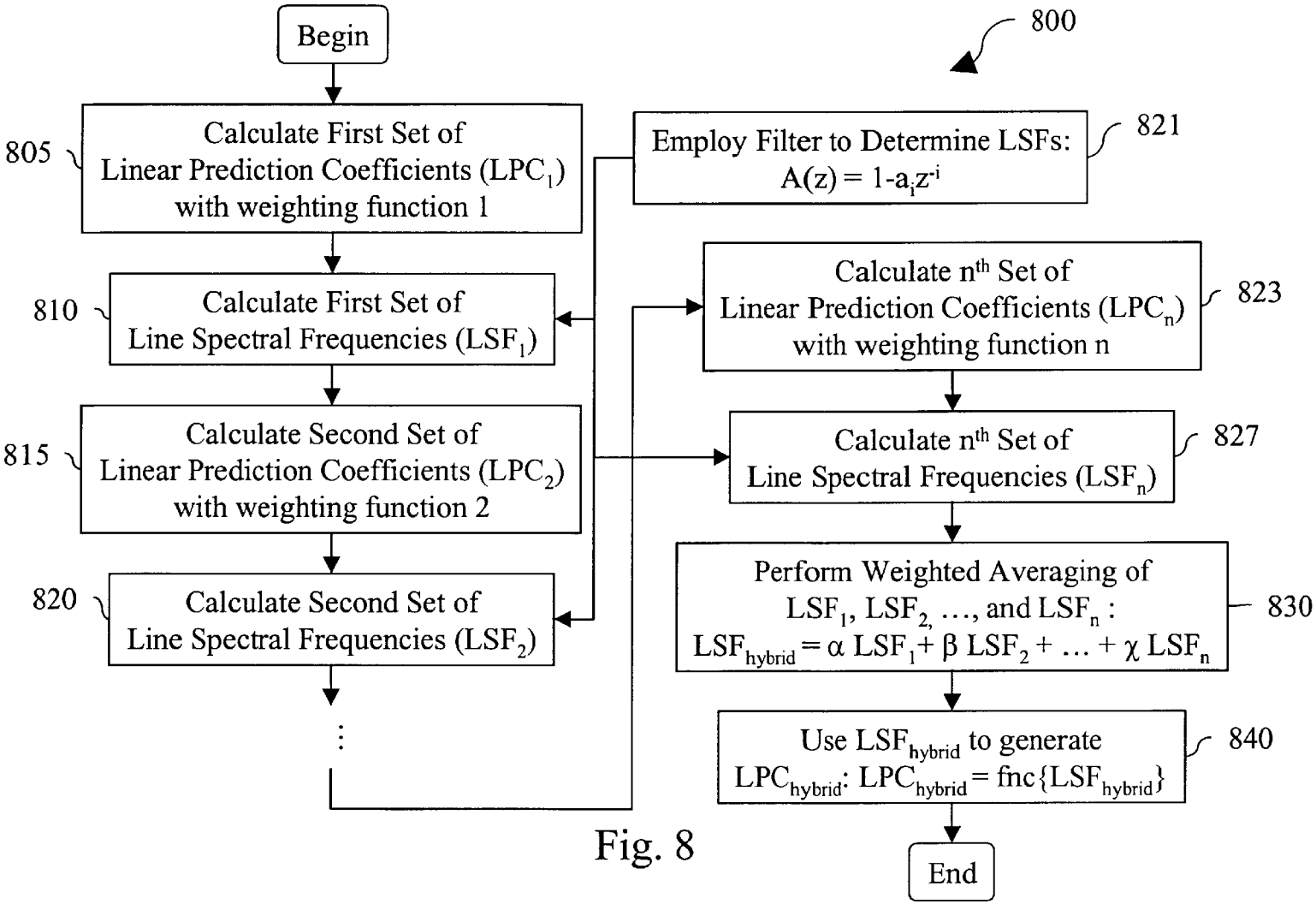
FIG. 8 is a functional block diagram illustrating an embodiment of a speech coding method that calculates line spectral frequencies corresponding to an indefinite number of sets of linear prediction coefficients and uses the line spectral frequencies to generate a hybrid set of linear prediction coefficients corresponding to an input speech signal.

FIG. 8 is a functional block diagram illustrating an embodiment of a speech coding method 800 that calculates line spectral frequencies corresponding to an indefinite number of sets of linear prediction coefficients and uses the line spectral frequencies to generate a hybrid set of linear prediction coefficients corresponding to an input speech signal.

In a block 805, a first set of linear prediction coefficients ($LPC_1$) is calculated using a first weighting function on the speech signal. If desired, a low pass tilted filter is used to perform the first weighting function on the speech signal in certain embodiments of the invention as similarly shown in certain aspects of the speech coding method 500 illustrated in FIG. 5 dealing with applying a low pass tilted filter to the speech signal and as shown in the speech coding method 700 of FIG. 7. Any other weighting function is applied to the speech signal in the block 805 to help calculate the first set of linear prediction coefficients ($LPC_1$); the specific use of either a low pass tilted filter or a high pass tilted filter is merely exemplary of one type of weighting that is performed to the speech signal in calculating the first set of linear prediction coefficients ($LPC_1$) as shown in the block 805. For the first set of linear prediction coefficients ($LPC_1$) that is calculated in the block 805, a first set of line spectral frequencies ($LSF_1$) is calculated is calculated in a block 810. Extracting line spectral frequencies from a speech signal is known in the art of speech signal processing.

In one embodiment of the invention, a number of auto-correlation coefficients are generated from the speech signal, then a number of reflection coefficients ($K_i$) are generated using the auto-correlation coefficients, then first set of linear prediction coefficients ($LPC_1$) are generated using the number of reflection coefficients ($K_i$), and finally the first set of line spectral frequencies ($LSF_1$) is generated using the first set of linear prediction coefficients ($LPC_1$). In this way, the generation of the first set of line spectral frequencies ($LSF_1$) is derivative from the first set of linear prediction coefficients ($LPC_1$).

If desired, a filter is employed to calculate the first set of line spectral frequencies ($LSF_1$) as shown by the filter in a block 821. In the block 821, a filter is applied to the input speech signal to determine its line spectral frequencies as shown by the following single poled filter in one embodiment of the invention.

$$A(z)=1-a_i z^{-i}$$

Subsequently, in a block 815, a second set of linear prediction coefficients ($LPC_2$) is calculated using a second weighting function on the speech signal. If desired, a high pass tilted filter is used to perform the first weighting function on the speech signal in certain embodiments of the invention as similarly shown in certain aspects of the speech coding method 500 illustrated in FIG. 5 dealing with applying a low pass tilted filter to the speech signal and as shown in the speech coding method 700 of FIG. 7. Any other weighting function is applied to the speech signal in the block 815 to help calculate the second set of linear prediction coefficients ($LPC_2$); the specific use of either a low pass tilted filter or a high pass tilted filter is merely exemplary of one type of weighting that is performed to the speech signal in calculating the second set of linear prediction coefficients ($LPC_2$) as shown in the block 815. For the second set of linear prediction coefficients ($LPC_2$) that is calculated in the block 815, a second set of line spectral frequencies ($LSF_2$) is calculated is calculated in a block 820. If desired, the filter of the block 821 is also employed to calculate the second set of line spectral frequencies ($LSF_s$) as shown in the block 820.

In one embodiment of the invention, a number of auto-correlation coefficients are generated from the speech signal, then a number of reflection coefficients ($K_i$) are generated using the auto-correlation coefficients, then second set of linear prediction coefficients ($LPC_2$) are generated using the number of reflection coefficients ($K_i$), and finally the second set of line spectral frequencies ($LSF_2$) is generated using the second set of linear prediction coefficients ($LPC_2$). In this way, the generation of the second set of line spectral frequencies ($LSF_s$) is derivative from the second set of linear prediction coefficients ($LPC_s$).

Subsequently, in a block 823, an $n^{th}$ set of linear prediction coefficients ($LPC_n$) is calculated using an $n^{th}$ weighting function on the speech signal. If desired, a low pass tilted filter, or a high pass tilted filter is used to perform the first weighting function on the speech signal in certain embodiments of the invention as similarly shown in certain aspects of the speech coding method 500 illustrated in FIG. 5 dealing with applying a low pass tilted filter to the speech signal and as shown in the speech coding method 700 of FIG. 7. Any other weighting function is applied to the speech signal in the block 823 to help calculate the $n^{th}$ set of linear prediction coefficients ($LPC_n$); the specific use of either a low pass tilted filter or a high pass tilted filter is merely exemplary of one type of weighting that is performed to the speech signal in calculating the $n^{th}$ set of linear prediction coefficients ($LPC_n$) as shown in the block 823. For the $n^{th}$ set of linear prediction coefficients ($LPC_n$) that is calculated in the block 823, an $n^{th}$ set of line spectral frequencies ($LSF_2$) is calculated is calculated in a block 827. If desired, the filter of the block 821 is also employed to calculate the $n^{th}$ set of line spectral frequencies ($LSF_n$) as shown in the block 827.

In one embodiment of the invention, a number of auto-correlation coefficients are generated from the speech signal, then a number of reflection coefficients ($K_i$) are generated using the auto-correlation coefficients, then second set of linear prediction coefficients ($LPC_2$) are generated using the number of reflection coefficients ($K_i$), and finally the $n^{th}$ set of line spectral frequencies ($LSF_n$) is generated using the $n^{th}$ set of linear prediction coefficients ($LPC_n$). In this way, the generation of the $n^{th}$ set of line spectral frequencies ($LSF_n$) is derivative from the $n^{th}$ set of linear prediction coefficients ($LPC_n$).

After each of the first set of line spectral frequencies ($LSF_1$), the second set of line spectral frequencies ($LSF_2$), and the $n^{th}$ set of line spectral frequencies ($LSF_n$) are calculated in each of the blocks 810, 820, and 827 corresponding to the first set of linear prediction coefficients ($LPC_1$), the second set of linear prediction coefficients ($LPC_2$), and the $n^{th}$ set of linear prediction coefficients ($LPC_n$) that are calculated in the blocks 805, 815, and 823, respectively, the first set of line spectral frequencies ($LSF_1$), the second set of line spectral frequencies ($LSF_2$), and the $n^{th}$ set of line spectral frequencies ($LSF_n$) are combined in a block 830 using a weighted averaging as shown below in one embodiment of the invention.

$$LSF_{hybrid}=\alpha\, LSF_1+\beta LSF_2+\ldots+\chi LSF_n$$

The particular values of the weighting parameters "α", "β", and "χ" that are used to perform the weighted averaging of the first set of line spectral frequencies ($LSF_1$), the second set of line spectral frequencies ($LSF_2$), and the $n^{th}$ set of line spectral frequencies ($LSF_n$) are defined by the user employing the speech coding method 800. If desired, the weighting parameters "α", "β", and "χ" are adaptively adjusted to various parameters of the speech signal and the weighting of various portions of the speech signal is modified as a function of the speech signal.

In this embodiment of the invention, the first set of line spectral frequencies ($LSF_1$), the second set of line spectral frequencies ($LSF_2$), and the $n^{th}$ set of line spectral frequencies ($LSF_n$) are combined into a single, hybrid set of line spectral frequencies ($LSF_{hybrid}$) in the block 830. Then, in a block 840, a single, hybrid set of linear prediction coefficients ($LPC_{hybrid}$) is generated from the input speech signal using the single, hybrid set of line spectral frequencies ($LSF_{hybrid}$) that is generated in the block 830. From certain perspectives, the hybrid set of linear prediction coefficients ($LPC_{hybrid}$) of the block 840 is a function of the hybrid set of line spectral frequencies ($LSF_{hybrid}$) of the block 830.

$$LPC_{hybrid}=fnc\{LSF_{hybrid}\}$$

The multiple sets of line spectral frequencies (LSFs) (the first set of line spectral frequencies ($LSF_1$), the second set of line spectral frequencies ($LSF_2$), and the $n^{th}$ set of line spectral frequencies ($LSF_n$)) are used to perform linear combination as combination using line spectral frequencies (LSFs) can be more stable than performing a straightforward linear combination of the linear prediction coefficients (LPCs) in certain embodiments of the invention. Alternatively, the linear prediction coefficients (LPCs) can be linearly combined directly as shown above in the various embodiments of the invention, but the intervening use of the line spectral frequencies (LSFs) to perform the linear combination of the linear prediction coefficients (LPCs) is operable without departing from the scope and spirit of the invention.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A speech codec that performs linear prediction speech coding on a speech signal, the speech codec comprising:

an encoder circuitry, the speech signal provided to the encoder circuitry;

a decoder circuitry communicatively coupled to the encoder circuitry;

a communication link configured to communicatively couple the encoder circuitry and the decoder circuitry;

a linear prediction coefficient parameter extraction circuitry configured to extract at least two sets of linear prediction coefficients during the coding of the speech signal, the linear prediction coefficient parameter extraction circuitry comprising:

a first speech signal processing circuitry configured to extract a first set of linear prediction coefficients representative of a first emphasized component of the speech signal in a speech signal frame; and a second speech signal processing circuitry configured to extract a second set of linear prediction coefficients representative of a second emphasized component of the speech signal in the speech signal frame; and a linear prediction coefficient combination circuitry configured to combine the first and second sets of linear prediction coefficients to generate a single set of linear prediction coefficients comprising a hybrid of the first and second sets of linear prediction coefficients.

2. The speech codec of claim 1, wherein the linear prediction coefficient combination circuitry is configured to convert the first and second sets of linear prediction coefficients into corresponding first and second sets of line spectral frequencies, and the first and second sets of line spectral frequencies are used by the linear prediction coefficient combination circuitry to generate the single set of linear prediction coefficients.

3. The speech codec of claim 2, wherein at least one of the first and second emphasized portions of the speech signal is based on a speech signal characteristic of the one of the first and second emphasized portions of the speech signal.

4. The speech codec of claim 1, wherein at least one of the first and second emphasized portions of the speech signal is based on a speech signal characteristic of the one of the first and second emphasized portions of the speech signal, and the other of the first and second emphasized portions of the speech signal is based on the entire speech signal.

5. The speech codec of claim 1, wherein at least one of the first and second emphasized portions of the speech signal is based on a pre-emphasized speech signal characteristic of the speech signal.

6. The speech codec of claim 1, wherein the linear prediction coefficient parameter extraction circuitry is further configured to extract at least one additional set of linear prediction coefficients during the coding of the speech signal.

7. The speech codec of claim 6, wherein the linear prediction coefficient combination circuitry is configured to combine the first, second, and at least one additional set of linear prediction coefficients into a number N of sets of linear prediction coefficients, wherein the number N of sets is less that the number of sets comprising the first, second and at least one additional sets of linear prediction coefficients.

8. The speech codec of claim 1, wherein the linear prediction coefficient combination circuitry is configured to apply a weighted averaging to combine the first and second sets of linear prediction coefficients.

9. The speech codec of claim 1, wherein at least one of the first and second emphasized portions of the speech signal is based on the frequency range of the one of the first and second emphasized portions of the speech signal.

10. The speech codec of claim 1, wherein the linear prediction coefficient combination circuitry is further configured to convert at least one of the first and second sets of linear prediction coefficients into a set of line spectral frequencies prior to generating the single set of linear prediction coefficients.

11. A speech coding system that performs hybrid extraction of linear prediction coefficients during.coding of a speech signal, the speech coding system comprising:

a linear prediction coefficient parameter extraction circuitry configured to extract at least two sets of linear prediction coefficients during the coding of the speech signal in a speech signal frame, at least one of the at least two sets of linear prediction coefficients generated from a pre-emphasized component of the speech signal based on a speech signal characteristic of the speech signal in the speech signal frame; and a linear prediction coefficient combination circuitry configured to combine the at least two sets of linear prediction coefficients to generate a single set of linear prediction coefficients comprising a hybrid of the at least two sets of linear prediction coefficients.

12. The speech coding system of claim 11, wherein each of the at least two sets of linear prediction coefficients are generated from a pre-emphasized component of the speech signal.

13. The speech coding system of claim 11, wherein the linear prediction coefficient combination circuitry is further configured to convert at least one of the two sets of linear prediction coefficients into a set of line spectral frequencies prior to generating the single set of linear prediction coefficients.

14. The speech coding system of claim 11, wherein the linear prediction coefficient combination circuitry is configured to:

calculate a first set of line spectral frequencies from the speech signal using at least one of the at least two sets of linear prediction coefficients;

calculate a second set of line spectral frequencies from the speech signal using the other of the at least two sets of linear prediction coefficients;

combine the first and second sets of line spectral frequencies to generate a single set of line spectral frequencies comprising a hybrid of the first and second sets of the line spectral frequencies; and transform the single set of line spectral frequencies to generate the single set of linear prediction coefficients.

15. The speech coding system of claim 11, wherein each of the at two sets of linear prediction coefficients are generated from corresponding pre-emphasized components of the speech signal.

16. The speech coding system of claim 11, wherein the combination that is performed to generate the single set of linear prediction coefficients is performed in at least one of the parameter domains of a reflection coefficients parameter domain, an auto-correlation coefficients parameter domain, and an original speech signal parameter domain.

17. The speech coding system of claim 11, wherein at least one of the at least two sets of linear prediction coefficients corresponds to a high frequency component of the speech signal; and at least one other of the at least two sets of linear prediction coefficients correspond to a low frequency component of the speech signal.

18. The speech coding system of claim 11, wherein the speech coding system is contained within a speech codec, the speech codec comprising an encoder circuitry and a decoder circuitry; and the linear prediction coefficient parameter extraction circuitry and the linear prediction coefficient combination circuitry are contained in the encoder circuitry of the speech codec.

19. The speech coding system of claim 11, wherein at least one of the two sets of linear prediction coefficients is based on a speech signal characteristic of the speech signal.

20. The speech coding system of claim 11, wherein the linear prediction coefficient combination circuitry is configured to apply a weighted averaging to combine the first and second sets of linear prediction coefficients.

21. A method that performs hybrid extraction of linear prediction coefficients from a speech signal, the method comprising:

calculating a first set of linear prediction coefficients from the speech signal in a speech signal frame;

calculating a second set of linear prediction coefficients from the speech signal in the speech frame, at least one of the at least two sets of linear prediction coefficients generated from a pre-emphasized component of the speech signal based on a speech signal characteristic of the speech signal; and combining the first and second sets of linear prediction coefficients to generate a single set of linear prediction coefficients comprising a hybrid of the first and second sets of linear prediction coefficients.

22. The method of claim 21, further comprising calculating at least one additional set of linear prediction coefficients from the speech signal; and combining the first and second sets of linear prediction coefficients with the at least one additional set of linear prediction coefficients to generate a number N of sets of linear prediction coefficients, wherein the number N of sets is less that the number of sets comprising the first, second and at least one additional sets of linear prediction coefficients.

23. The method of claim 21, further comprising:

calculating a first set of line spectral frequencies from the speech signal using the first set of linear prediction coefficients from the speech signal; and calculating a second set of line spectral frequencies from the speech signal using the second set of linear prediction coefficients from the speech signal.

24. The method of claim 23, further comprising:

combining the first and'second sets of line spectral frequencies into a single set of line spectral frequencies comprising a hybrid of the first and second sets of line spectral frequencies; and transforming the single set of line spectral frequencies into the single set of linear prediction coefficients.

25. The method of claim 21, wherein the combining the first and second sets of linear prediction coefficients comprises applying a weighted filer to the first and second sets of linear prediction coefficients.

26. The method of claim 21, wherein each of the two sets of linear prediction coefficients is based on a speech signal characteristic of the speech signal.

27. The method of claim 21, wherein at least one of the two sets of linear prediction coefficients is based on the frequency range of the speech signal corresponding to the one of the two sets of linear prediction coefficients.

* * * * *